United States Patent [19]

Billman et al.

[11] Patent Number: 4,950,847

[45] Date of Patent: Aug. 21, 1990

[54] SEALED PRINTED CIRCUIT BOARD SWITCH

[76] Inventors: Timothy B. Billman, Rt. 2, Box 115, King, N.C. 27021; Roger L. Thrush, 6985 Lanvale Ct., Clemmons, N.C. 27012

[21] Appl. No.: 379,517

[22] Filed: Jul. 13, 1989

[51] Int. Cl.[5] ..... H01H 15/02

[52] U.S. Cl. ..... 200/16 D; 200/284; 200/294; 200/295

[58] Field of Search ..... 200/16 R, 16 B, 16 C, 200/16 D, 16 E, 16 F, 11 D, 11 DA, 291, 547–532, 284, 294, 295

[56] References Cited

U.S. PATENT DOCUMENTS

| | | | |
|---|---|---|---|
| 3,499,126 | 3/1970 | Jones et al. | 200/16 R |
| 3,525,827 | 8/1970 | Allison | 200/11 D |
| 3,974,346 | 8/1976 | Keprda | 200/16 D X |
| 4,012,608 | 3/1977 | Lockard | 200/16 D |
| 4,029,917 | 6/1977 | Webster | 200/5 R |
| 4,095,060 | 6/1978 | Keprda | 200/16 D |
| 4,168,404 | 9/1979 | Lockard | 200/16 D X |
| 4,376,234 | 3/1983 | Liataud et al. | 200/16 R |
| 4,398,069 | 8/1983 | Olsson | 200/6 R |
| 4,441,000 | 4/1984 | Suwa | 200/548 X |
| 4,454,391 | 6/1984 | Olsson | 200/16 R X |
| 4,529,851 | 7/1985 | Priebe et al. | 200/16 D |
| 4,704,503 | 11/1987 | Takasawa | 200/16 B |
| 4,749,827 | 6/1988 | Wagatsuma et al. | 200/16 D |
| 4,814,565 | 3/1989 | Bingo et al. | 200/291 |
| 4,841,105 | 6/1989 | Goodman et al. | 200/16 D |

*Primary Examiner*—J. R. Scott

*Attorney, Agent, or Firm*—Robert W. Pitts

[57] ABSTRACT

A printed circuit board slide switch in which switch actuation occurs by movement of a slide actuator perpendicular to the printed circuit board on which the switch is mounted is disclosed. Terminals having leads in a zig-zag configuration are inserted molded into an insulative body which has a plurality of individual compartments in which side-by-side contact portions of adjacent terminals comprising switched terminal pairs are located.

18 Claims, 7 Drawing Sheets

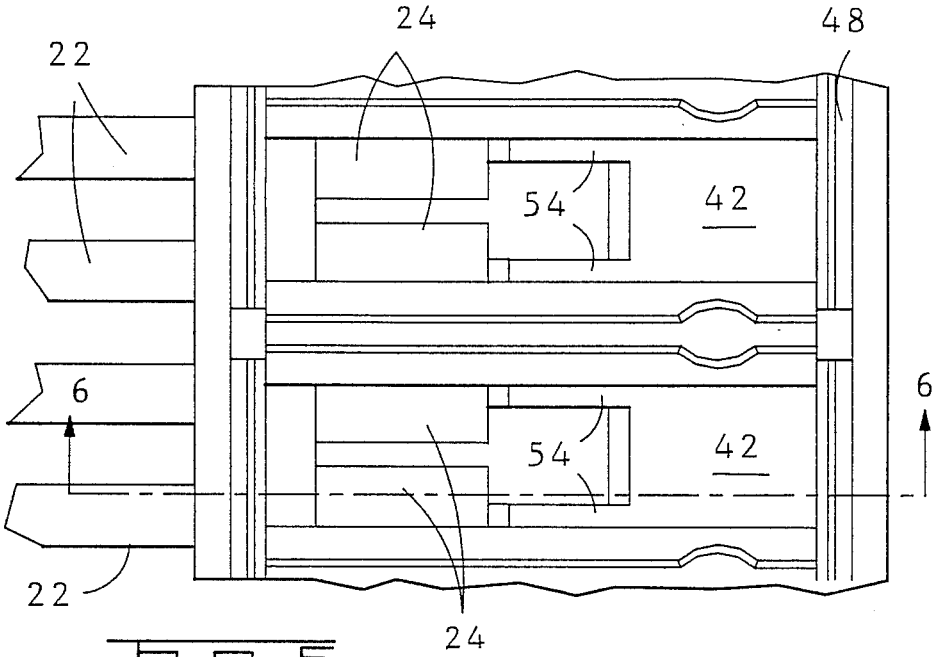
Fig. 5
Fig. 6
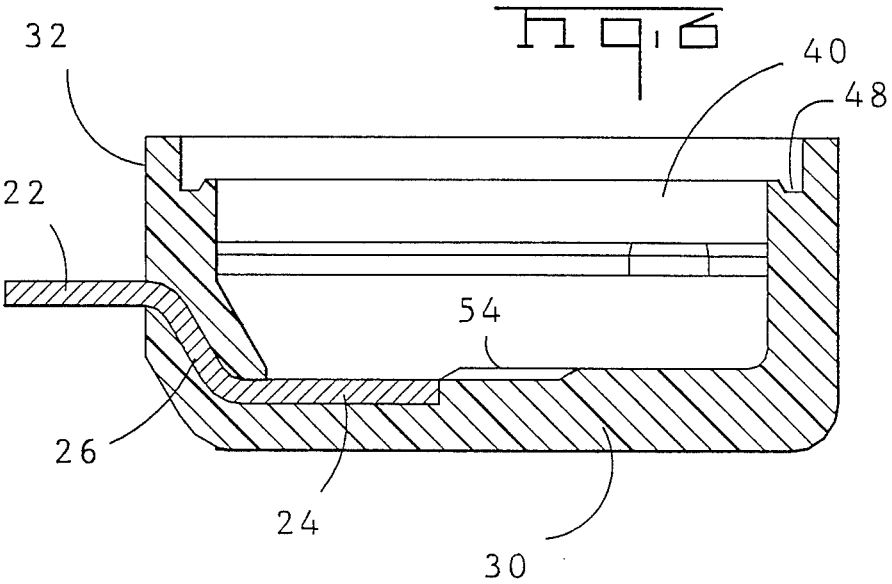

SEALED PRINTED CIRCUIT BOARD SWITCH

BACKGROUND OF THE INVENTION

1. Field of the Invention

This invention relates to a switch for use in connecting and disconnecting circuits on a printed circuit board and more particularly to a sealed switch in which switch actuation occurs by movement perpendicular to the printed circuit board on which the switch is mounted.

2. Description of the Prior Art

Switches configured as dual inline packages (DIP switches) are utilized within electronic equipment to change the configuration of the equipment. For example, DIP switches are typically found on items such as mother boards within computers or on expansion cards or auxiliary cards which are mounted within the computer. The switches allow easy changes in con on in the system, for example, the configuration of a system can be varied to change the output location or printer or plotter model by merely changing the switch settings.

The DIP switches can either be installed and soldered directly to the printed circuit board or the switch can be inserted within a DIP socket similar to that shown in U.S. Pat. No. 4,060,296 to Kunkle, et al. which is soldered to the board. This latter practice enables a faulty switch to be replaced without the complexity of unsoldering the switch from the board.

Such a switch is shown in U.S. Pat. No. 4,454,391 to Olsson where the switch includes a plurality of leads extending outwardly from the body for interconnection to the printed circuit board. The fixed ends of the leads which extend into the housing are spaced apart a sufficient distance to prevent shorting therebetween. A spring metal slide is located between the two lead fixed ends and is moveable towards and away from, one of the lead fixed ends to connect and disconnect the two opposed leads.

Additional printed circuit board switches configured as a standard DIP switch are disclosed in the following patents: U.S. Pat. No. 4,012,608 discloses a "DIP switch" in which the switch contact beams comprise inwardly extending contact arms which cross intermediate their ends. Partition walls in the housing base are interposed between contact pairs. Pressure sensitive adhesive backed tape is shown secured to the top of the cover to prevent contamination of the DIP switch components. U.S. Pat. No. 4,168,404 discloses a DIP switch assembly allowing impedance programming. U.S. Pat. No. 4,376,234 discloses a DIP switch in which the switch contacts have downwardly bent curved sections comprising 4 contact legs in which the contact legs on the same end of the switch contact are separated by separation slots. Dimples are provided at the contact point of each switch contact leg. U.S. Pat. No. 4,398,069 discloses a DIP switch employing a rocker type switch actuator. U.S. Pat. No. 4,814,565 discloses a sealed slotted switch in which the seal is positioned between the housing and the cover. U.S. patent application Ser. No. 179,603 filed Apr. 11, 1988, now U.S. Pat. No. 4,841,105 discloses a DIP switch in which a lip on the cover is received within a channel in the insulating housing and the cover and lower insulating housing are ultrasonically welded together. The ultrasonic welding technique employed therein is also disclosed in U.S. patent application Ser. No. 179,602 filed Apr. 11, 1988.

U.S. Pat. No. 3,499,126 discloses an electrical contact assembly with a ramp guide in which contact is made between adjacent terminals on a cylindrical switch assembly. U.S. Pat. No. 4,704,503 discloses a slide action switch in which a proJection is engaged by a moveable contact member to move the moveable contact member away from the surface of a conductive component.

None of these prior art disclosures show a printed circuit board switch in which the switch is actuated by movement towards and away from the printed circuit board. Conventional DIP switch configurations employ switches in which the slot actuator is moved in a direction parallel to the printed circuit board. The instant invention, having the switch actuators movable perpendicular to the printed circuit board, allows the switch to be positioned along the edge of the printed circuit board where the slide actuators are readily accessible. The DIP switches disclosed in the prior art employ a printed circuit board pattern corresponding to the traditional in-line configuration used with DIP components. The instant invention, on the other hand, employs leads in a zig-zag configuration in which the leads are staggered for insertion in a staggered array of a printed circuit board through holes. The instant invention also employs a printed circuit board slide switch in which separate compartments are formed within the insulative body, with the slide actuators being shiftable within separate compartments, each containing a pair of side-by-side contact portions of adjacent terminals. The slide actuators engage compartment walls to maintain the position of the slide actuators.

SUMMARY OF THE INVENTION

A printed circuit board slide switch actuated by movement towards and away from the printed circuit board on which the slide switch is mounted employs an insulative body with a plurality of side-by-side terminals. Slide actuators shifted towards and away from a printed circuit board are mounted within the insulative body and are shiftable from a first position in which the slide actuators bridge side-by-side contact portions of adjacent terminals to a second position in which the switch contacts on the slide actuators are shifted out of engagement with at least one of the side-by-side contact portions by a cam shoulder or ledge positioned at the end of the contact portion. The switch can be used to alternately connect and disconnect circuits on a printed circuit board. Adjacent leads on the terminals are staggered in a zig-zag configuration. The insulative body of the switch has a plurality of side-by-side compartments with the contact portions of side-by-side contact terminals positioned within each compartment. Slide actuators used to connect and disconnect adJacent terminals are shiftable from a first position to a second position between the walls dividing each individual compartment. Frictional engagement between the slide actuators and the walls tends to maintain the position of the slide actuators until shifted by application of a sliding force.

BRIEF DESCRIPTION OF THE DRAWINGS

FIG. 3 is a perspective view showing the manner in which the terminals are insert molded into the insulative body of the slide switch.

FIG. 5 is a top fragmentary plan view of a portion of the housing with the contacts shown in the housing.

FIG. 6 is a cross-sectional view taken along lines 6—6 of FIG. 5.

DETAILED DESCRIPTION OF THE PREFERRED EMBODIMENT

Figure 1:
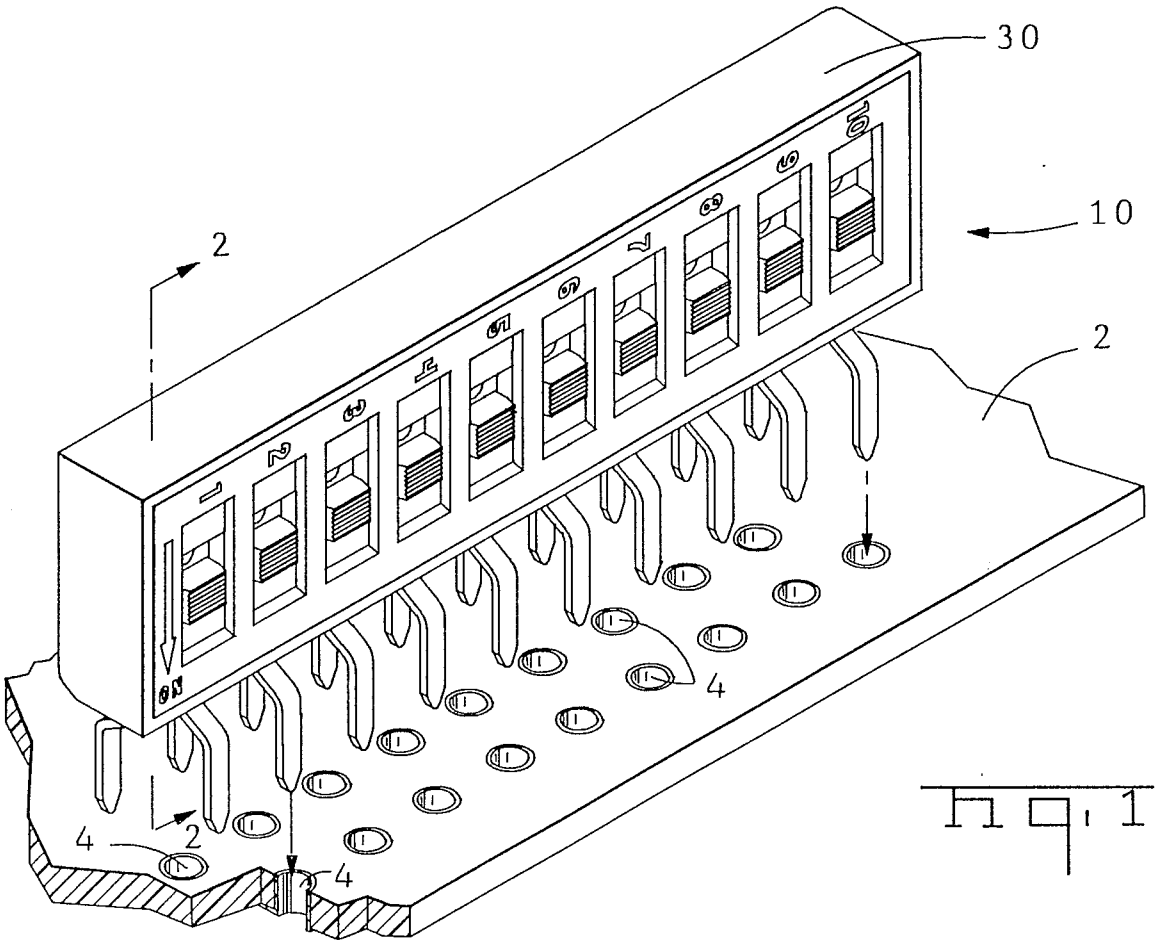
FIG. 1 is a perspective view of the switch assembly exploded above a printed circuit board having a staggered through hole pattern.

A slide switch 10 for use with a printed circuit board 2 having plated through holes 4 comprises the preferred embodiment of this invention. The slide switch 10 is actuated by movement towards and away from the printed circuit board 2. The slide switch can be mounted on the printed circuit board 2 adjacent one edge of the printed circuit board so that the slide switch 10 is readily accessible so that the respective switches can be programmed in any desired manner. Thus, the slide switch 10 comprises a simple means for connecting and disconnecting circuits on the printed circuit board 2. The slide switch 10 is especially suitable for use with a printed circuit board having plated through holes 4 in which holes in adjacent rows are staggered in a zig-zag configuration.

The slide switch 10, comprising the preferred embodiment of this invention, includes a plurality of terminals 20 located within an insulative body 30. Each of the terminals 20 comprise a lead 22 extending on the exterior of the insulative body 30 and a contact portion 24 located on the interior of the insulative body. The insulative body 30 has a plurality of compartments 40, each defined by opposite walls 44 protruding upwardly from a floor 42. The leads 22 project outwardly from a first side 32 of the insulative body 30. The leads are positioned adjacent a second side 34 which is adjacent to the first side 32. A cover 90 is secured to the insulative body 30 on a third side or face 36 which is opposite from the floor and opposite from the second side. The third side 36 is adjacent to the first side 32 of the insulative body 30.

Adjacent terminals 20 comprise switched terminal pairs and a contact portions 24 of adjacent terminals 20 are located side-by-side in a common compartment in the preferred embodiment of the invention. The switched terminal pairs extend into their corresponding compartment 40 from a first end of compartment 40 which corresponds to the first side 32 of the insulative body 30. The leads 22 extend outwardly from the first side 32 in a common plane. The planer section **22*a* of each lead 22 is located adjacent the insulative body 30. Offset lead sections 22*b* are located intermediate the ends of the lead and through hole lead section 22*c* extending parallel to the other through hole lead section 22*c* of other terminals 22 extending from each offset lead section 22*b*. Adjacent terminals are offset or staggered in opposite directions so that the leads 22 and the through hole lead sections 22*c* form a staggered or zig-zag configuration for insertion into staggered plated through holes 4 in a printed circuit board 2**.

The contact portions 24 of the individual terminals 20 are located within the insulative body adjacent the second side. Contact portions 24 of at least two terminals are located on the floor of each compartment 40 on the interior of the insulative body 30. In the preferred embodiment of this invention these contact portions 24 are embedded in the floor of the compartments 40 of the insulative body 30 with one piece of each contact portion 24 exposed within the interior of the insulative body 30. Contact portions 24 of adjacent terminals 20 in the same compartment 40 are positioned side-by-side.

Adjacent compartments 40 are separated by walls 44 which subdivide the interior of the insulative body 30 into a plurality of separate compartments. Each of the separate compartments comprise a track extending generally perpendicular to the first side 32 of the insulative body 30. Since the first side 32 of the insulative body 30 is to be mounted adjacent the upper surface of a printed circuit board, the tracks formed by compartments 40 extend at right angles to the printed circuit board 2 on which a slide switch 10 is mounted. The cover 90 is secured to the insulative body along the open third side. Cover 90 thus encloses the open side 36 and appropriate sections of the cover 90 comprise at least a portion of the top of each compartment 40. It should be noted that cover 90 also includes a plurality of slots 96, each slot 96 being aligned in one corresponding compartment 40. In the preferred embodiment of this invention the cover 90 is secured to the insulative body 30 by ultrasonically welding the cover 90 to the insulative body 30. The cover 90 has a peripheral lip 92 which fits within a corresponding peripheral groove 48 on the insulative body 30 along the third side thereof, and the lip 92 is positioned within the peripheral groove 48 in preparation for ultrasonically welding the cover 90 to the insulative body 30.

Slide actuators 60 shiftable towards and away from the printed circuit board 2 are located within each compartment 40. Each slide actuator 60 is confined between the walls 44 of each corresponding compartment 40. Slide actuator 60 comprise an insulative member 62 to which a switch contact 64 is attached. Switch contact 64 comprises means for bridging side-by-side contact portions 24 of switch terminal pairs located within each compartment 40 when the slide actuator 60 is in a first position. In the preferred embodiment of this invention, the first position is that position occupied by the switch contact when it is adjacent the first side 32 of the insulative body 30. Each slide actuator 60 is shiftable from the first position to a second position, spaced further from the printed circuit board 2 as the slide actuator 60 moves within the track formed by the walls 44 of the insulative body which extend in a direction orthogonal to the first side 32.

Figure 2:
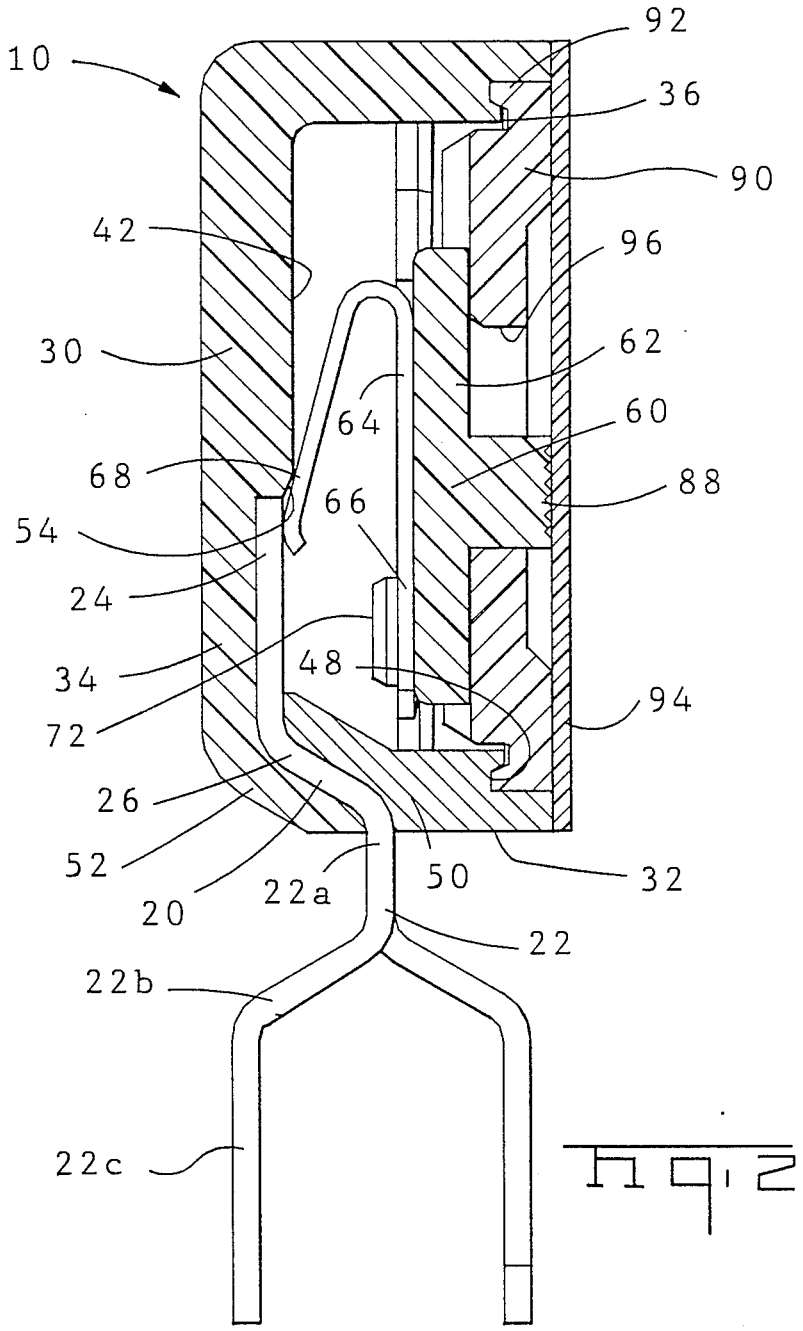
FIG. 2 is a sectional view taken along the section lines 2—2 of FIG. 1.
Figure 1:
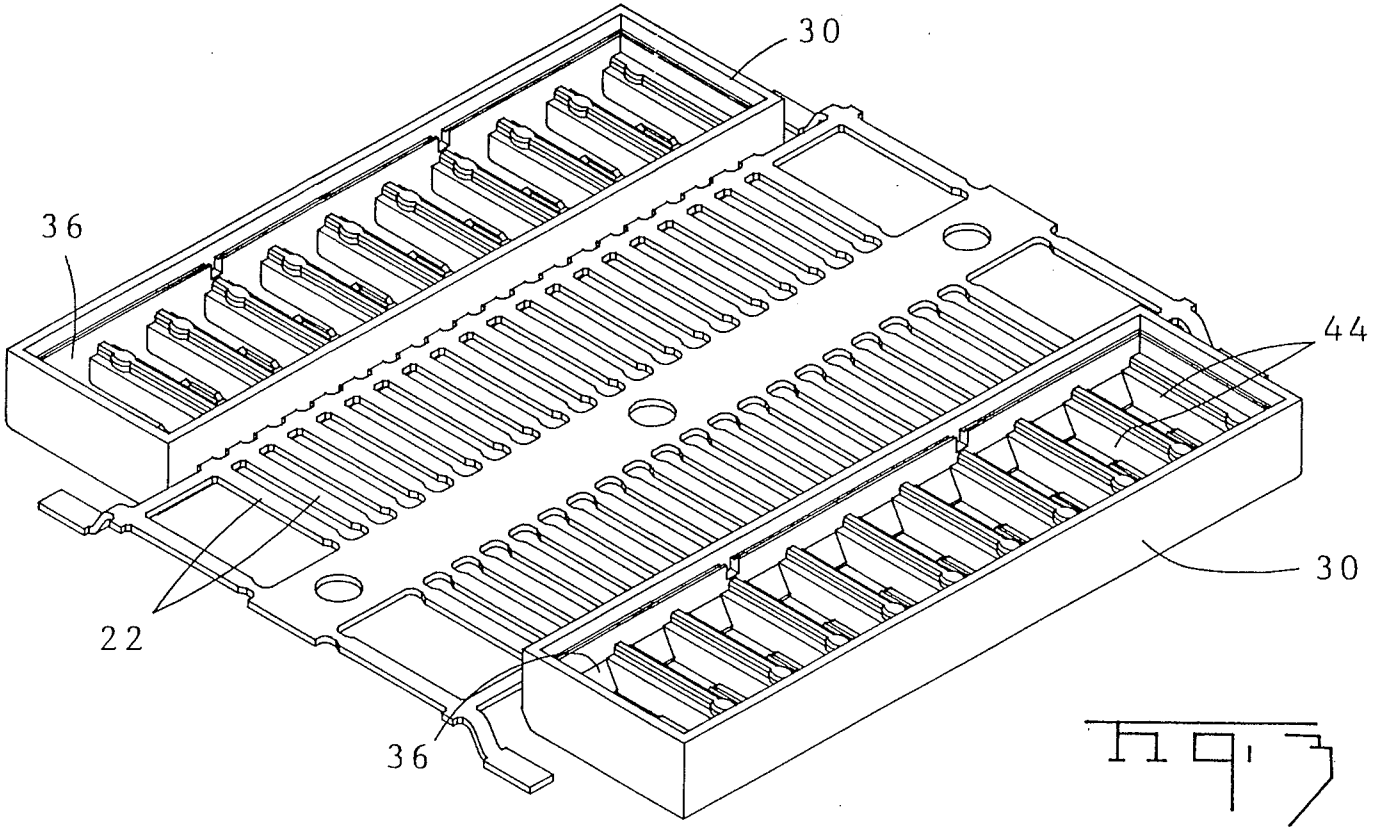
Figure 4:
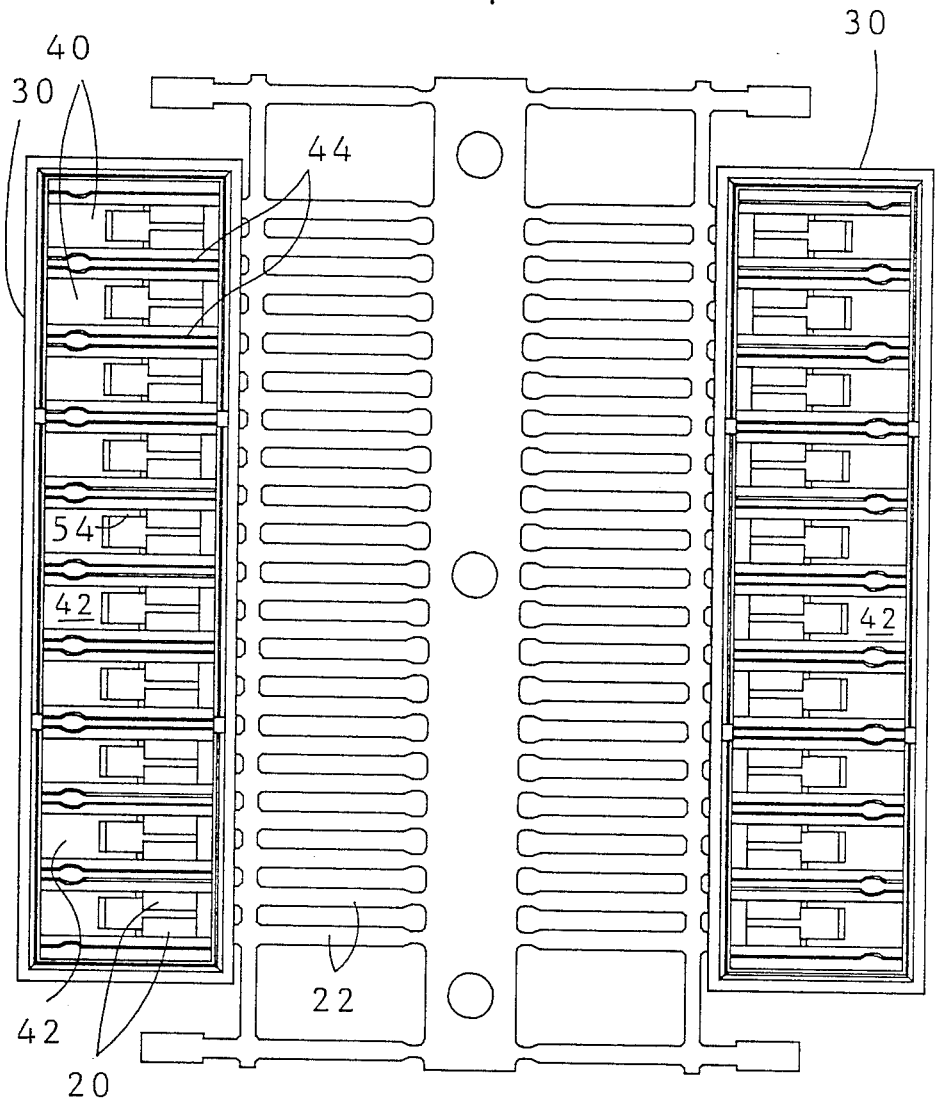
FIG. 4 is a plan view showing the housing and terminal arrays as depicted in FIG. 3.
Figure 10:
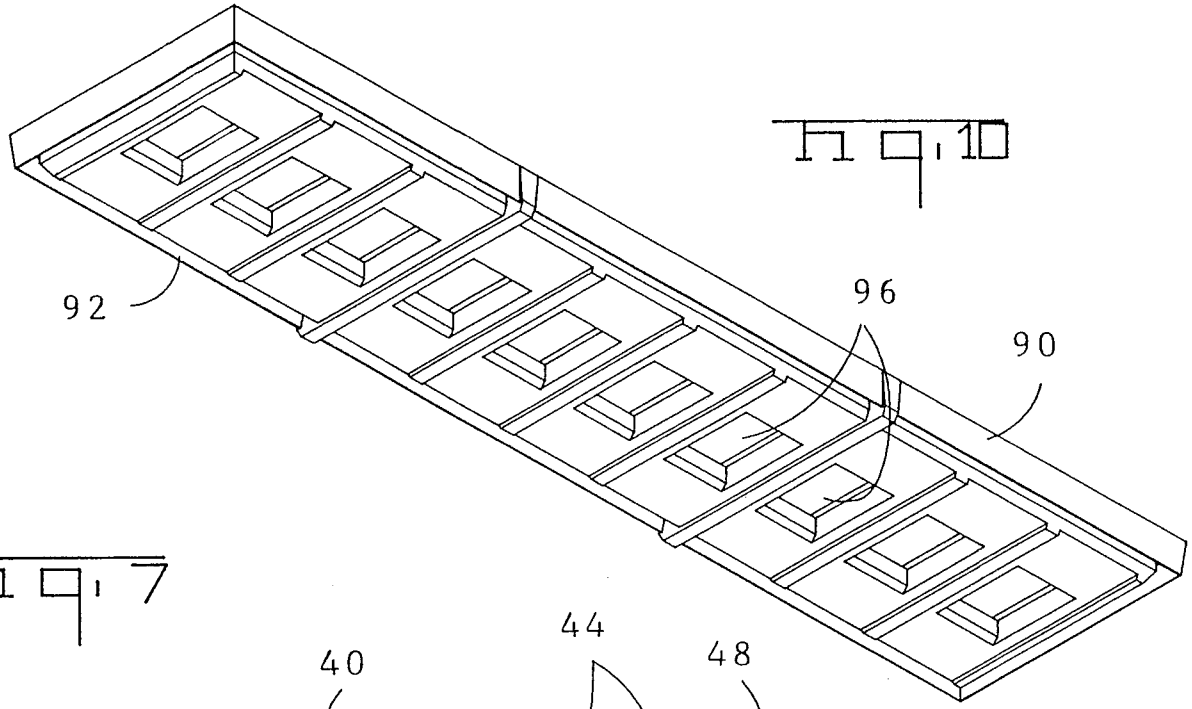
FIG. 10 is a perspective view showing the cover from beneath.
Figure 7:
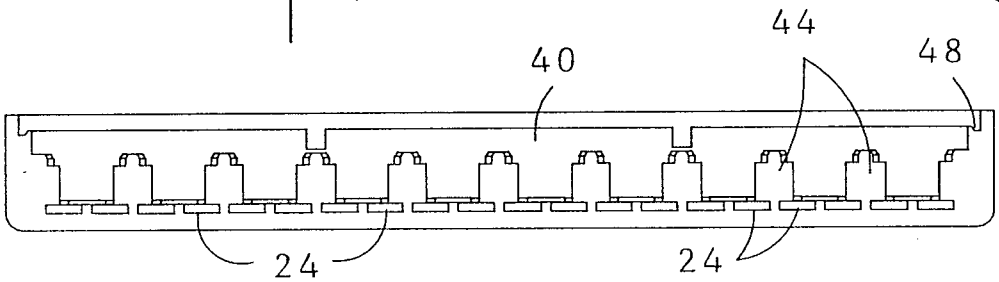
FIG. 7 is a sectional view through the housing showing walls projecting upwardly from the base of the housing to define separate compartments.
Figure 8:
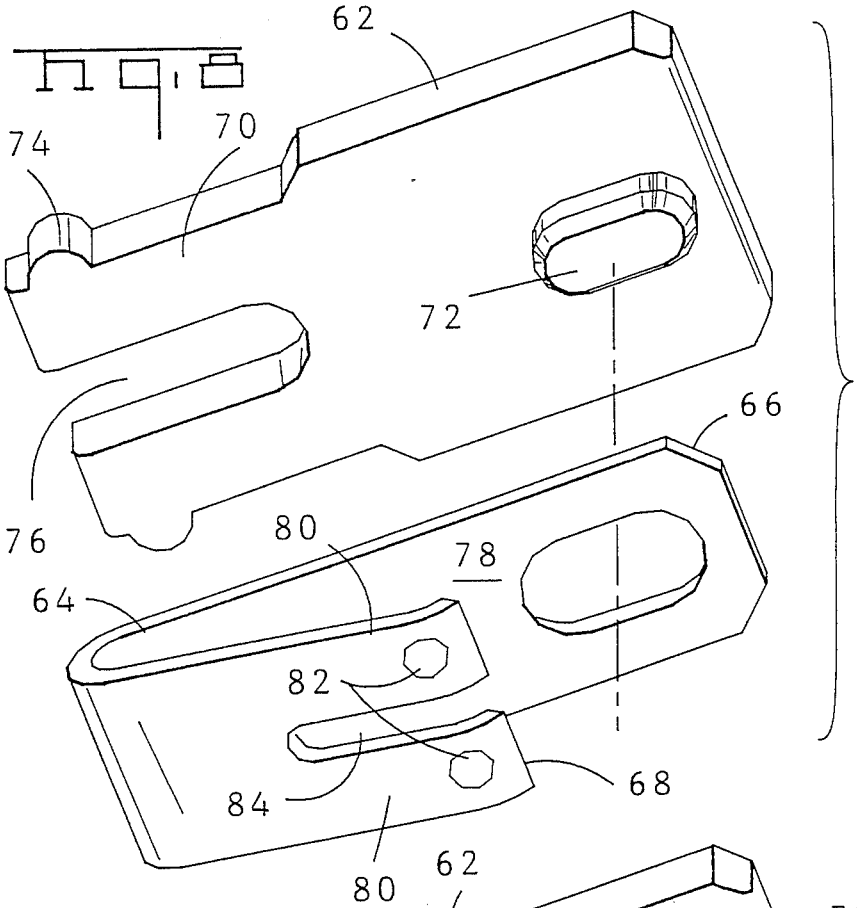
FIGS. 8 and 9 are perspective views of the switch actuator showing the positioning of the switch contact on the insulative member to form the slide actuator.
Figure 9:
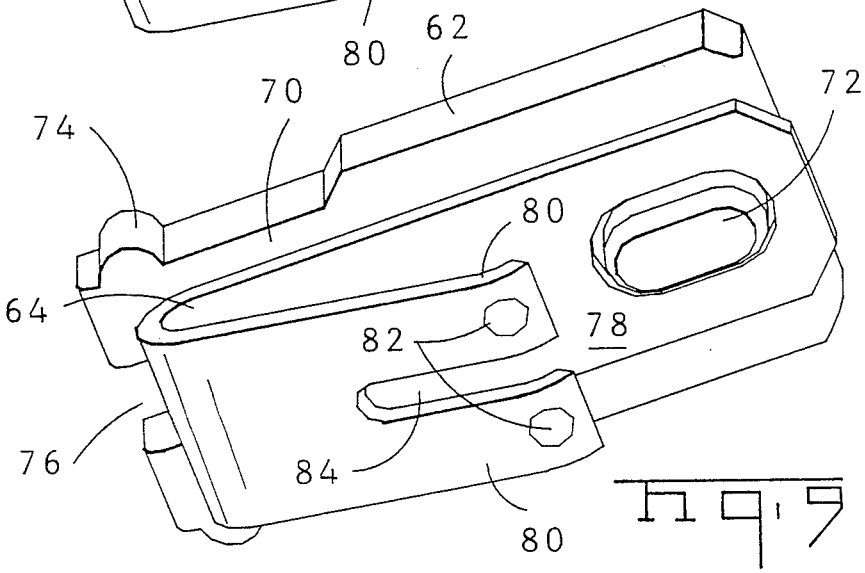

Each switch contact 64 is secured to an insulative member 62 at one end 66. The other end 68 of the switch contact is formed by an angle greater than 90° relative to the one end 66 to form a resilient spring. With the switch contact secured to the switch actuator 62 at the one end 66, the other end 68 of the switch contact can be flexed out of engagement with one or both corresponding contact portions 24 of the switch terminal pairs upon movement of the switch contact away from the printed circuit board 2 along a track that extends at right angles relative to the printed circuit board. The switch contact 64 is flexed out of engagement with one or both contact portions 64 when the switch contact 66 is brought into engagement with a camming shoulder or ledge 54. Shoulders or ledges 54 are, in the preferred embodiment of this invention, located at the end of contact portions 24. These camming shoulders, or ledges, are engagable with the slide actuator when the slide actuator 60 is shifted from the first to the second position. In the preferred embodiment of this invention shoulders or ledges 54 having a width less than the width of the contact portion 64 extend upwardly from the floor 42 of the compartments 40. These ledges 54, located adjacent walls 44 extend for a portion of the distance between the free end of each contact portion 24 and the opposite side of the insulative body. When the switch contact 64 is shifted from the first position, shown in FIG. 2, in which the switch contact engages the contact portions 24 of the switch terminal pairs to a second position, further away from the printed circuit board 2, the switch contact 64 engages a beveled surface at the end of the ledge 54 adjacent contact portions 24. This angled end 68 of switch contact 64 is thus bent upwardly out of engagement from the contact portions 24.

The insulative member 62 has two parallel beams 70 extending outwardly from the portion of the insulative member 62 to which the switch contact 64 is attached. These beams each have a dimple 74 located along their outer edge and each pair of beams 70 are separated by a slot 76. The dimple 74 extending laterally outwardly from the beams 70 engages the inner surfaces of the walls 44 and serve to maintain the position of the slide actuator 60, because of the frictional force between the beams 70 and the walls 44. Each switch contact is secured to the insulative member 62 by a knob 72 which extends through a hole in the switch contact base 78. Stamped, flexible switch contact beams 80 are located in the resilient spring end 68 of the switch contact 64 and hertz dots 82. Hertz dots 82 are located on each of the stamped, flexible switch contact beams 80 which are separated by intermediate switch contact slot 84.

A button 88 located on the insulative member 62 extends through the slots or windows 96 in the cover 90. Movement of the slide actuators 60 is affected by engagement of these buttons 88 which are permitted to move within the windows 96 as the switch contact 64 and the insulative member 62 move in a track form between walls 44 of each compartment 40.

The preferred embodiment of this invention comprises a sealed printed circuit board switch. This sealed configuration is achieved by insert molding each terminal into the insulative body 30. Each of the terminals 20 is insert molded with embedded angle portions 26, located between the leads 22 and the contact portions 24 located within an angled web 52 in a sidewall 50 on the first side 32 of the insulative body 30. Thus, each of the leads or terminals extends along an angled contour through this sidewall relative to the orientation of the contact portions 24 and the through hole lead sections 22. This angled contour 26, with the terminal embedded within the sidewall 50 provides a excellent seal to prevent moisture from seeping into the interior of the insulative body 30. A sealing membrane 94 is secured on the outside of the cover 90 by conventional means such as by adhesively securing the sealing membrane 94 to the cover 90 and to the ends of the insulative body 30 extending beyond the lips 92 on cover 90.

It should be understood that the inventive features of this printed circuit board slide switch could be incorporated into other configurations. For example, the leads 22 could be bent in the section **22*a* so that the insulative body could be positioned in a flat configuration along the the surface of printed circuit board 2. Switch actuation would then occur by movement of the slide actuators 60 parallel to the printed circuit board 2. Furthermore, a switch configuration having the leads extending from opposite sides, in the same configuration as with conventional DIP switches, could be employed with a slide actuator located in separate compartments in the housing in the manner depicted in the preferred embodiment of this invention. The same angled contour of the leads, insert molded in the insulative body 30** is also adaptable to a printed circuit board slide switch having the leads in a conventional DIP configuration.

We claim:

1. A printed circuit board slide switch actuated by movement towards and away from a printed circuit board on which the printed circuit board slide switch is mounted, comprising:

an insulative body having a first side and a second side adjacent the first side:

a plurality of side by side terminals each having leads extending from the first side and contact portions located within the insulative body adjacent to the second side;

slide actuators shiftable towards and away from the printed circuit board, each slide actuator having a switch contact bridging side by side contact portions of adjacent terminals when the slide actuator is in a first position; and cam means on the housing engagable with the slide actuator when the slide actuator is shifted from the first to the second position for camming the switch contact out of engagement with at least one of the corresponding side by side contact portions of adjacent terminals when the slide actuator is shifted from the first to the second position;

whereby the slide switch can be mounted on a printed circuit board with the first side of the insulative body positioned adjacent the printed circuit board with the leads engaging the printed circuit board and the slide switch can be actuated by movement of the switch actuators along the second side towards and away from the printed circuit board.

2. The printed circuit board slide switch of claim 1 wherein the switch contact is secured to the switch actuator at one end, the other end of the switch contact being formed by an angle greater the 90 degrees relative to the one end to form a resilient spring extending at an angle relative to the contact portions of adjacent terminals.

3. The printed circuit board slide switch of claim 2 wherein the cam means comprises at least one shoulder adjacent an end of one of the adjacent contact portions of adjacent terminals, the shoulder engaging the switch contact to flex the switch contact out of engagement with the corresponding contact portion.

4. The printed circuit board slide switch of claim 3 wherein each switch contact is flexed out of engagment with the corresponding contact portion upon movement of the switch contact away from the first side of the insulative body and away from the printed circuit board upon which the slide switch is mounted.

5. The printed circuit board slide switch of claim 4 wherein the insulative body includes a plurality of adjacent compartments separated by walls protruding from a floor, contact portions of at least two terminals being located on the floor of each compartment.

6. The printed circuit board slide switch of claim 5 wherein at least one shoulder protrudes from the floor of each compartment.

7. The printed circuit board slide switch of claim 6 wherein each compartment forms a track in which a slide actuator can be shifted between the first and the second position between the walls protruding from the floor.

8. The printed circuit board slide switch of claim 7 wherein a cover is secured to the insulative body on a third side of the body, the third side of the body being opposite from the second side and the first side comprises a sidewall extending between the second side and the first side, the cover having windows through which actuating buttons on the corresponding slide actuator extend.

9. The printed circuit board slide switch of claim 8 wherein a sealing member is secured over the cover and the terminals are insert molded in the insulative body to form a sealed slide switch.

10. The printed circuit board slide switch of claim 1 wherein the leads of adjacent terminals are staggered.

11. A switch for use on a printed circuit board to alternately connect and disconnect circuits on the printed circuit board, the switch comprising:

an insulative body;

a plurality of terminals each having leads extending from the insulative body and contact portions located on the interior of the insulative body;

at least one slide actuator having a switch contact engagable with the contact portions of two terminals in a first position, the slide actuator being shiftable to a second position to disengage the switch contact from the contact portion of at least one terminal;

the switch being characterized in that the leads of the terminals extend in a common plane through only one side of the insulative body;

each lead being bent at a position spaced from the one side so that adjacent leads are staggered in a ziz-zag configuration, and the portion of the leads extending through the one side having an embedded angular contour relative to the orientation of the contact portions.

12. The switch of claim 11 wherein the contact portions are embedded within a floor on the interior of the insulative body with one face exposed within the interior of the insulative body.

13. The switch of claim 12 wherein the interior of the insulative body in subdivided into a plurality of separate compartments and the slide actuator comprises an insulative member to which the slide contact is attached, the contact portions of a plurality of terminals being located on the floor in each compartment with each switch contact and at least a portion of each insulative member being located within the compartment.

14. The switch of claim 13 wherein the insulative body has an open side opposite from the floor, a plurality of walls protruding from the floor toward the open side, individual compartments being defined by the walls.

15. The switch of claim 14 wherein one slide actuator is positioned within each compartment between the walls.

16. The switch of claim 15 wherein the insulative member has at least one beam engaging one of the walls defining the corresponding compartment to maintain the slide actuator in either the first or second position until a positive force is applied to shift the slide actuator to the other position.

17. The switch of claim 16 wherein at least one ledge protrudes from the floor of each compartment beyond the contact portions, the switch contacts engaging a corresponding ledge when the slide actuator is shifted to the second position to disengage the switch contact from a corresponding contact portion of at least one terminal.

18. The switch of claim 17 wherein each compartment has the contact portion of two adjacent terminals embedded in the floor thereof with an upper face of the contact portions being exposed in the compartment.

* * * * *

UNITED STATES PATENT AND TRADEMARK OFFICE

CERTIFICATE OF CORRECTION

PATENT NO. : 4,950,847

DATED : August 21, 1990

INVENTOR(S) : Timothy Billman, et al

It is certified that error appears in the above-identified patent and that said Letters Patent is hereby corrected as shown below:

In the Abstract:

Line 5, the word "inserted" should be --insert--.

Signed and Sealed this

Twenty-second Day of September, 1992

*Attest:*

DOUGLAS B. COMER

*Attesting Officer*

*Acting Commissioner of Patents and Trademarks*